US007915984B2

(12) United States Patent
Niimi

(10) Patent No.: US 7,915,984 B2
(45) Date of Patent: Mar. 29, 2011

(54) STARTER SOLENOID SWITCH WITH IMPROVED ARRANGEMENT OF RESISTOR

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 243 days.

(21) Appl. No.: 12/379,235

(22) Filed: Feb. 17, 2009

(65) Prior Publication Data

US 2009/0206965 A1 Aug. 20, 2009

(30) Foreign Application Priority Data

Feb. 20, 2008 (JP) ..... 2008-039233
Dec. 22, 2008 (JP) ..... 2008-325261

(51) Int. Cl.
*H01H 67/02* (2006.01)

(52) U.S. Cl. ..... 335/126; 335/131

(58) Field of Classification Search ..... 335/126, 335/131, 132; 290/38 R, 48
See application file for complete search history.

(56) References Cited

U.S. PATENT DOCUMENTS 5,159,908 A * 11/1992 Eyermann et al. ..... 123/179.1
5,528,084 A * 6/1996 Shiga et al. ..... 290/38 R
5,656,981 A * 8/1997 Niimi et al. ..... 335/126
6,360,707 B1 * 3/2002 Boegner ..... 123/179.25
6,759,756 B2 * 7/2004 Shiga et al. ..... 290/38 R
6,863,041 B2 * 3/2005 Nagai et al. ..... 123/179.25
6,923,152 B2 8/2005 Nagai et al.
7,034,643 B1 * 4/2006 Kusumoto et al. ..... 335/126
7,659,801 B2 * 2/2010 Kusumoto et al. ..... 335/126

FOREIGN PATENT DOCUMENTS

FR 2 632 685 A1 12/1989
JP A-9-177644 7/1997
JP A-9-190758 7/1997
JP A-2005-56690 3/2005
JP B2-3767550 4/2006
JP A-2007-207494 8/2007

OTHER PUBLICATIONS

European Search Report for European Patent Application No. 09 00 2365; Jun. 18, 2009; 2 pp.; Munich, Germany.

* cited by examiner

*Primary Examiner* — Ramon M Barrera
(74) *Attorney, Agent, or Firm* — Oliff & Berridge, PLC

(57) ABSTRACT

In a solenoid switch according to the invention, a magnetic plate is disposed on one side of a solenoid coil in an axial direction of the solenoid coil. A contact cover is arranged with the magnetic plate interposed between the contact cover and the solenoid coil in the axial direction. First and second fixed contacts are received in the contact cover and respectively electrically connected to first and second terminals that are to be electrically connected to an electric circuit. A resistor is electrically connected between the first and second terminals to limit current flowing through the electric circuit when the first and second fixed contacts are electrically disconnected by a movable contact. The resistor is received in the contact cover and interposed between the magnetic plate and the first and second fixed contacts in the axial direction.

11 Claims, 8 Drawing Sheets

STARTER SOLENOID SWITCH WITH IMPROVED ARRANGEMENT OF RESISTOR

CROSS-REFERENCE TO RELATED APPLICATIONS

This application claims priority from Japanese Patent Applications No. 2008-39233, filed on Feb. 20, 2008, and No. 2008-325261, filed on Dec. 22, 2008, the contents of which are hereby incorporated by reference into this application.

BACKGROUND OF THE INVENTION

1. Technical Field of the Invention

The present invention relates generally to solenoid switches (or electromagnetic switches) for controlling power supply to starter motors. More particularly, the invention relates to a solenoid switch which has an improved arrangement of a resistor that is used to limit electric current supplied to a starter motor.

2. Description of the Related Art

Japanese Patent No. 3767550, an English equivalent of which is U.S. Pat. No. 6,923,152 B2, discloses a starter for starting an internal combustion engine which includes a motor and a solenoid switch for driving the motor in two stages.

More specifically, the solenoid switch includes a pair of main contacts, a pair of auxiliary contacts, and a resistor. The main contacts are connected in parallel with the auxiliary contacts in an electric circuit of the starter for supplying electric power from a battery to the motor. The resistor is connected in series with the auxiliary contacts in the electric circuit.

During a starting operation, only the auxiliary contacts are closed in the first stage to supply limited current, which is limited by the resistor, to the motor. Consequently, the motor is energized to rotate at a low speed, facilitating establishment of an engagement between a pinion of the starter and a ring gear of the engine. As soon as the engagement between the pinion and the ring gear has been established, the main contacts are closed in the second stage to apply the full voltage of the battery to the motor, causing the motor to rotate at a high speed.

Moreover, in the solenoid switch, the resistor is arranged in a resin-made retainer so that it surrounds the radially outer periphery of a solenoid coil with an air gap formed between itself and the solenoid coil.

However, with the above arrangement of the resistor, the outer diameter of the solenoid switch is increased by an amount corresponding to the sum of the radial thicknesses of the air gap, resistor, and retainer.

Further, since the radially outer periphery of the solenoid coil is surrounded by the retainer via the resistor, it is difficult to dissipate heat generated by the solenoid coil in the radially outward direction. As a result, the temperature of the solenoid coil increases excessively, shortening the thermal withstand time of the solenoid coil.

To lower the temperature of the solenoid coil, one may consider enlarging the solenoid coil. However, this would increase the weight of the solenoid switch as well as make it difficult to minimize the solenoid switch.

SUMMARY OF THE INVENTION

The present invention has been made in view of the above-mentioned problems.

According to the present invention, there is provided a solenoid switch which includes a solenoid coil, a fixed core, an annular magnetic plate, a movable core, a resin-made contact cover, first and second terminals, first and second fixed contacts, a movable contact, and a resistor. The solenoid coil has a longitudinal axis. The fixed core is surrounded by the solenoid coil. The annular magnetic plate is disposed on one side of the solenoid coil in an axial direction of the solenoid coil. The magnetic plate has a through-hole formed through a radial center thereof. The movable core is movable in the axial direction of the solenoid coil toward and away from the fixed core through the through-hole of the magnetic plate. The contact cover is arranged with the magnetic plate interposed between the contact cover and the solenoid coil in the axial direction of the solenoid coil. The first and second terminals are fixed to the contact cover and protrude outside of the contact cover so as to be connected to an electric circuit. The first and second fixed contacts are received in the contact cover and respectively electrically connected to the first and second terminals. The movable contact is received in the contact cover and configured to be moved along with the movable core to electrically connect and disconnect the first and second fixed contacts. The resistor is electrically connected between the first and second terminals to limit current flowing through the electric circuit when the first and second fixed contacts are electrically disconnected. The resistor is received in the contact cover and interposed between the magnetic plate and the first and second fixed contacts in the axial direction of the solenoid coil.

According to further implementations of the invention, the resistor has first and second ends that are respectively joined to the first and second terminals and located away from a radially inner surface of the contact cover by predetermined distances.

The resistor extends, on a plane perpendicular to the axial direction of the solenoid coil, between the first and second ends with at least two bends.

Thermal resistance of the resistor is so predetermined that when the resistor is continuously energized, the resistor melts before the contact cover reaches its softening temperature.

The electric circuit, to which the first and second terminals are to be connected, is an electric circuit for supplying electric power to a starter motor.

The solenoid switch further includes a cup-shaped case that has first and second portions. The first portion includes a closed end of the case and has the solenoid coil received therein. The second portion includes an open end of the case and has an end portion of the contact cover fit thereinto. The first portion has a smaller outer diameter than the second portion.

The movable contact is located further from the magnetic plate than the first and second fixed contacts in the axial direction of the solenoid coil.

Each of the first and second terminals is shaped as a bolt. The first and second fixed contacts are formed respectively integral with the first and second terminals.

In a preferred embodiment of the invention, each of the first and second terminals is shaped as a bolt with a bore and two recesses. The bore opens on an axial end face of the bolt and has a predetermined depth. The two recesses are formed in a side surface of the bolt and opposed to each other in a radial direction of the bolt with the bore interposed therebetween. The resistor has first and second ends. The first end is inserted in the bore of the first terminal and joined to the first terminal by press-deforming bottoms of the recesses of the first terminal radially inward. The second end is inserted in the bore of the second terminal and joined to the second terminal by press-deforming bottoms of the recesses of the second terminal radially inward.

In another preferred embodiment of the invention, each of the first and second terminals is shaped as a bolt with a bore that opens on an axial end face of the bolt and has a predetermined depth. A brazing filler metal is provided in the bores of the first and second terminals. The resistor has first and second ends. The first end is inserted in the bore of the first terminal and joined to the first terminal by heating only part of the first terminal around the bore to melt the brazing filler metal in the bore. The second end is inserted in the bore of the second terminal and joined to the second terminal by heating only part of the second terminal around the bore to melt the brazing filler metal in the bore.

In yet another preferred embodiment of the invention, each of the first and second terminals is shaped as a bolt with a protrusion that protrudes from an axial end face of the bolt by a predetermined distance. The resistor has first and second ends that are respectively welded to the protrusions of the first and second terminals.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings.

DESCRIPTION OF PREFERRED EMBODIMENTS

Figure 1:
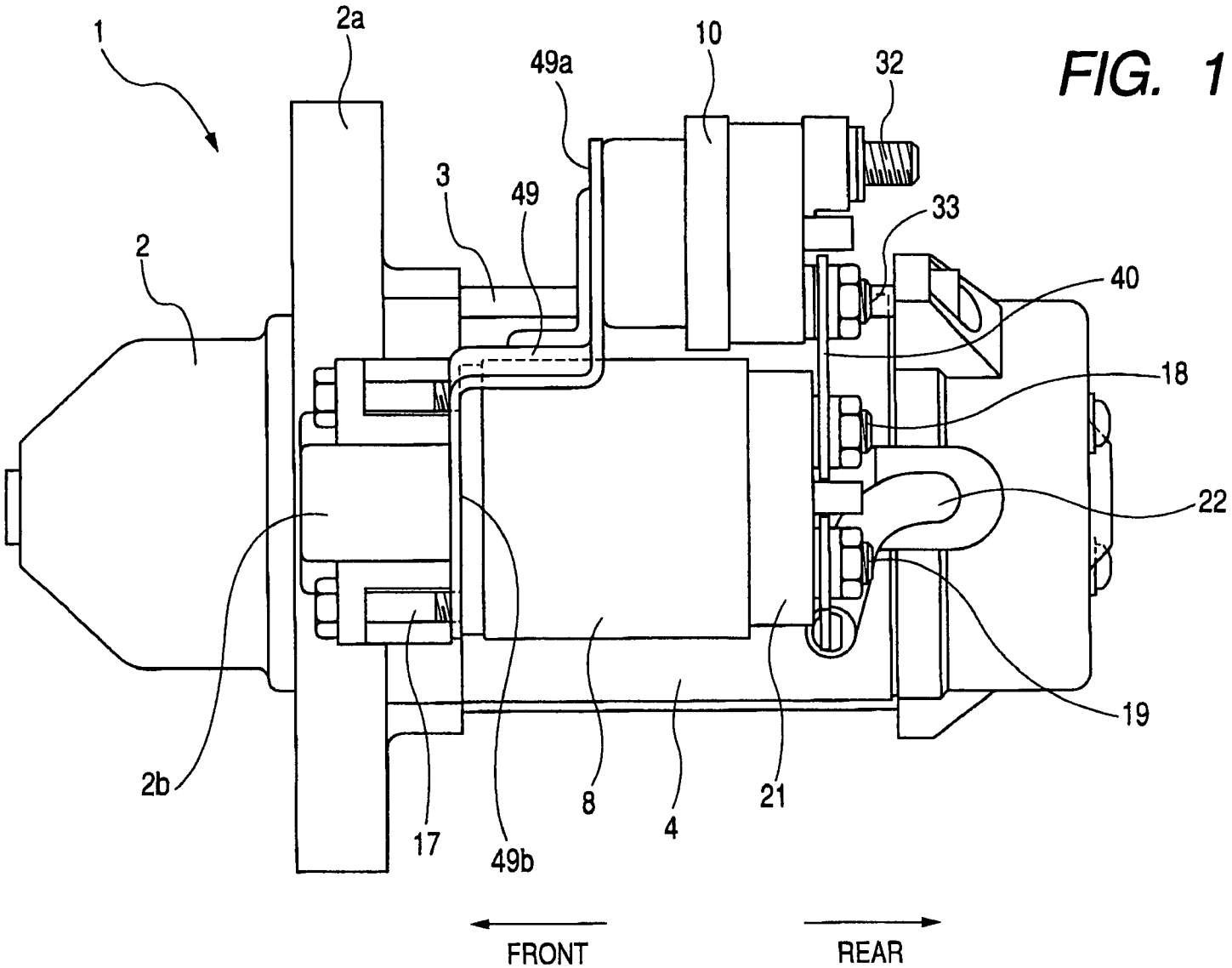
FIG. 1 is a plan view of a starter which includes a solenoid switch according to the first embodiment of the invention.

Preferred embodiments of the present invention will be described hereinafter with reference to FIGS. 1-8.

It should be noted that, for the sake of clarity and understanding, identical components having identical functions in different embodiments of the invention have been marked, where possible, with the same reference numerals in each of the figures.

First Embodiment

Figure 2:
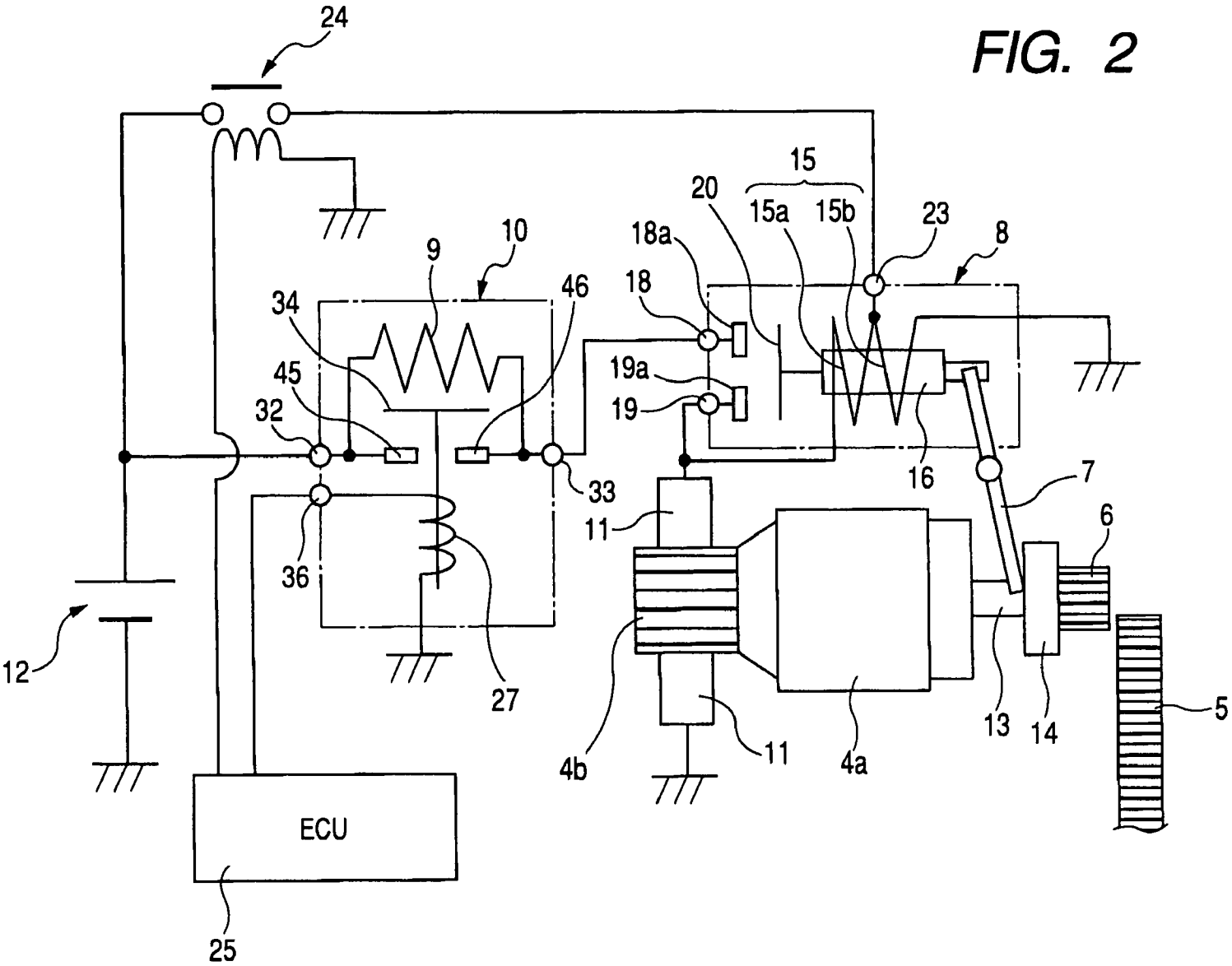
FIG. 2 is a circuit diagram of the starter of FIG. 1.

FIG. 1 shows the overall structure of a starter 1 for starting an internal combustion engine of a motor vehicle, which includes a solenoid switch 10 according to the first embodiment of the invention. FIG. 2 shows an electric circuit of the starter 1.

The starter 1 includes: a housing 2 that is mounted to the engine (not shown); a motor 4 that is fixed to the housing 2 by means of a plurality of through-bolts 3; a pinion 6 (shown in FIG. 2) that is configured to mesh with a ring gear 5 (shown in FIG. 2) of the engine to transmit the torque generated by the motor 4 to the engine; a shift lever 7 (shown in FIG. 2) that is configured to shift the pinion 6 in the axial direction of the starter 1 to bring the pinion 6 into and out of mesh with the ring gear 5; a solenoid switch 8 that serves as a main switch of starter 1; a resistor 9 for limiting electric current supplied from a battery 12 to the motor 4 during a starting operation; and the solenoid switch 10 according to the present embodiment which serves as an auxiliary switch of the starter 1. Hereinafter, the solenoid switches 8 and 10 will be simply referred to as main switch 8 and auxiliary switch 10, respectively.

The housing 2 has a flange portion 2*a*, which is fixed to a surface (not shown) of the engine, and a switch-mounting portion 2*b* to which the main switch 8 is fixed.

The motor 4 is implemented by a commutator motor of a type well-known in the art.

More specifically, as shown in FIG. 2, the motor 4 includes an armature 4*a*, a commutator 4*b* provided on an end portion (i.e., the left end portion in FIG. 2) of the armature 4*a*, and a pair of brushes 11 that are arranged around the radially outer periphery of the commutator 4*b* to make contacts with the commutator 4*b*. In operation, upon closing a pair of main contacts (to be described later) of the electric circuit, current is supplied from the battery 12 to the armature 4*a* via the contacts between the brushes 11 and the commutator 4*b*, causing the armature 4*a* to rotate.

The pinion 6 is provided together with a clutch 14 on an output shaft 13 which is driven by the motor 4, so that rotation of the output shaft 13 is transmitted to the pinion 6 via the clutch 14.

The main switch 8 is fixed, as shown in FIG. 1, to the switch-mounting portion 2*b* of the housing 2 by means of two through-bolts 17.

The main switch 8 includes, as shown in FIG. 2, solenoid coils 15, a plunger 16, a pair of fixed contacts 18*a* and 19*a* that make up the main contacts of the electric circuit of the starter 1, a pair of terminal bolts 18 and 19, and a movable contact 20.

The solenoid coils 15 create, when energized, a magnetic attraction for the plunger 16. The magnetic attraction causes the plunger 16 to move to close the main contacts of the electric circuit. Further, when the solenoid coils 15 are deenergized, the magnetic attraction disappears. Then, the plunger 16 is returned, by the force of a return spring (not shown), to its initial position, thereby opening the main contacts of the electric circuit.

The fixed contact 18*a* is electrically connected to the high voltage-side (i.e., the side of the battery 12) via the terminal bolt 18. On the other hand, the fixed contact 19*a* is electrically connected to the low voltage-side (i.e., the side of the motor 4) via the terminal bolt 19.

The movable contact 20 is configured to move along with the plunger 16 to connect (or bridge) and disconnect (or separate) the pair of fixed contacts 18*a* and 19*a*. More specifically, when the movable contact 20 makes contact with both the fixed contacts 18*a* and 19*a* to connect them, the main contacts of the electric circuit is closed. Moreover, when the movable contact 20 is detached from both the fixed contacts 18*a* and 19*a* to disconnect them, the main contacts are opened.

Both the terminal bolts 18 and 19 are fixed, as shown in FIG. 1, to a contact cover 21 of the main switch 8 which covers the fixed contacts 18*a* and 19*a* and the movable contact 20. The terminal bolt 19 is electrically connected to the positive-side brush 11 of the motor 4 via a lead 22 (shown in FIG. 1). The electrical connection of the terminal bolt 18 will be described later.

The solenoid coils 15 consist of a pull-in coil 15*a* and a hold-on coil 15*b*. The pull-in coil 15*a* has one end electrically connected to an energization terminal 23 (shown in FIG. 2), which is fixed to the contact cover 21 of the main switch 8, and the other end electrically connected to the terminal bolt 19. The hold-on coil 15*b* has one end electrically connected to the energization terminal 23 and the other end grounded via, for example, an iron core (not shown) of the main switch 8.

The energization terminal 23 is, as shown in FIG. 2, electrically connected to the battery 12 via a starter relay 24. In operation, when the starter relay 24 is turned on by an ECU 25, electric current is supplied from the battery 12 to the energization terminal 23, thereby energizing the solenoid coils 15. Here, the ECU 25 is an ECU (Electronic Control Unit) for controlling operation of the engine.

Figure 3:
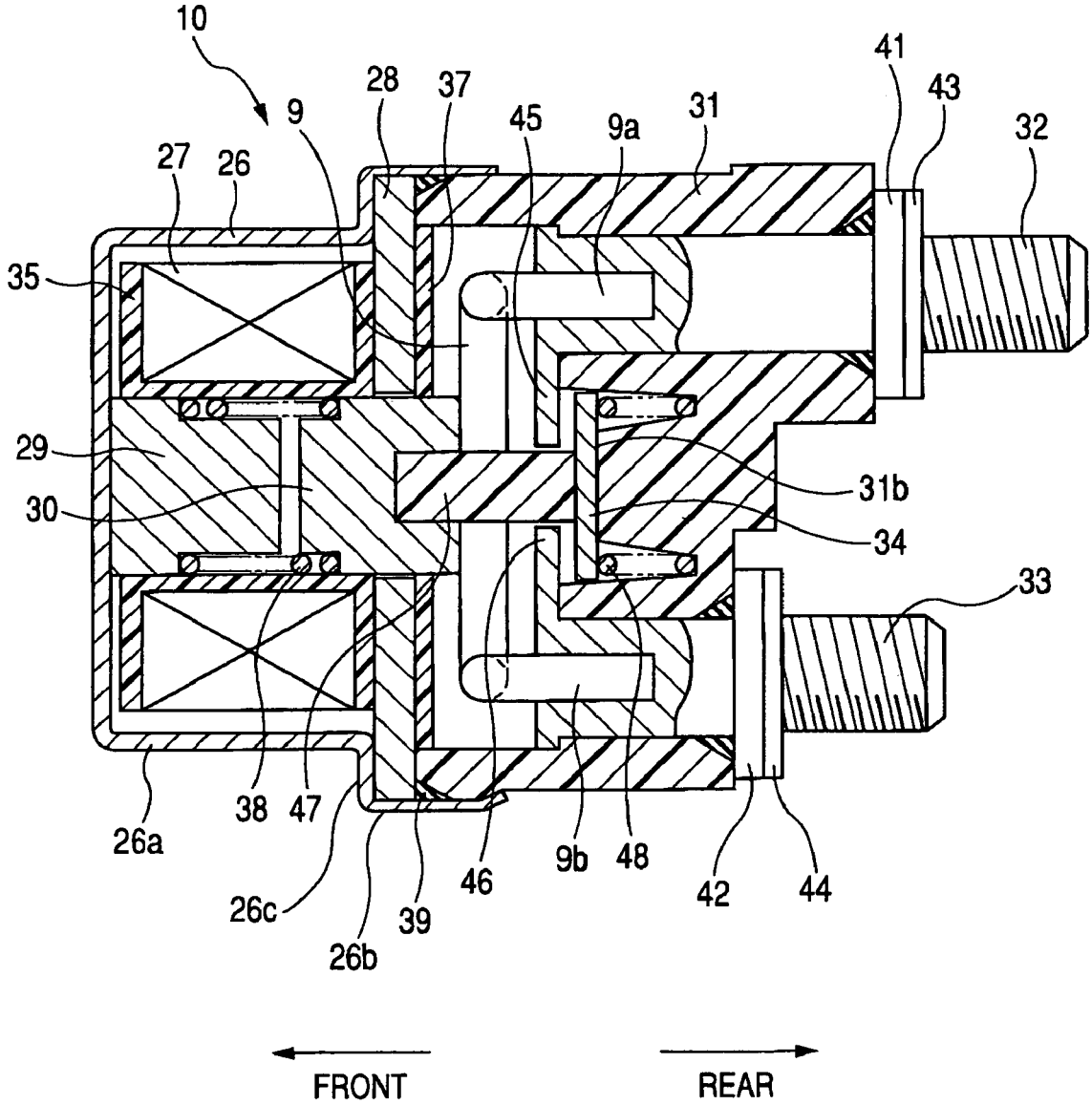
FIG. 3 is a partially cross-sectional view of the solenoid switch according to the first embodiment.

Referring now to FIG. 3, the auxiliary switch 10 includes: a cup-shaped case 26; a cylindrical solenoid coil 27 that has a longitudinal axis and is received in the case 26; a magnetic plate 28 that is disposed on the rear side of the solenoid coil 27; a fixed core 29 to be magnetized upon energization of the solenoid coil 27; a movable core 30 that is disposed on the rear side of the fixed core 29 to face it in the axial direction of the auxiliary switch 10 (i.e., the axial direction of the solenoid coil 27); a resin-made contact cover 31 that is disposed on the rear side of the magnetic plate 28 to close the open end of the case 26; a pair of terminal bolts 32 and 33 fixed to the contact cover 31; a pair of fixed contacts 45 and 46 that are formed respectively integral with the terminal bolts 32 and 33; and a movable contact 34 that is movable along with the movable core 30 to connect (or bridge) and disconnect (or separate) the fixed contacts 45 and 46. It should be noted that in FIGS. 1 and 3, the forward and backward directions are introduced only for convenience of explanation.

The case 26 forms, together with the magnetic plate 28 and the fixed core 29, a magnetic circuit (or a fixed magnetic path) of the auxiliary switch 10. The case 26 has a small-diameter portion 26*a* and a large-diameter portion 26*b* that has a larger diameter than the small-diameter portion 26*a*. The small-diameter portion 26*a* includes the closed end of the case 26 and has the solenoid coil 27 received therein. The large-diameter portion 26*b* includes the open end of the case 26 and has the magnetic plate 28 received therein. Moreover, between the small-diameter and large-diameter portions 26*a* and 26*b*, there is formed a step portion 26*c*.

Figure 4:
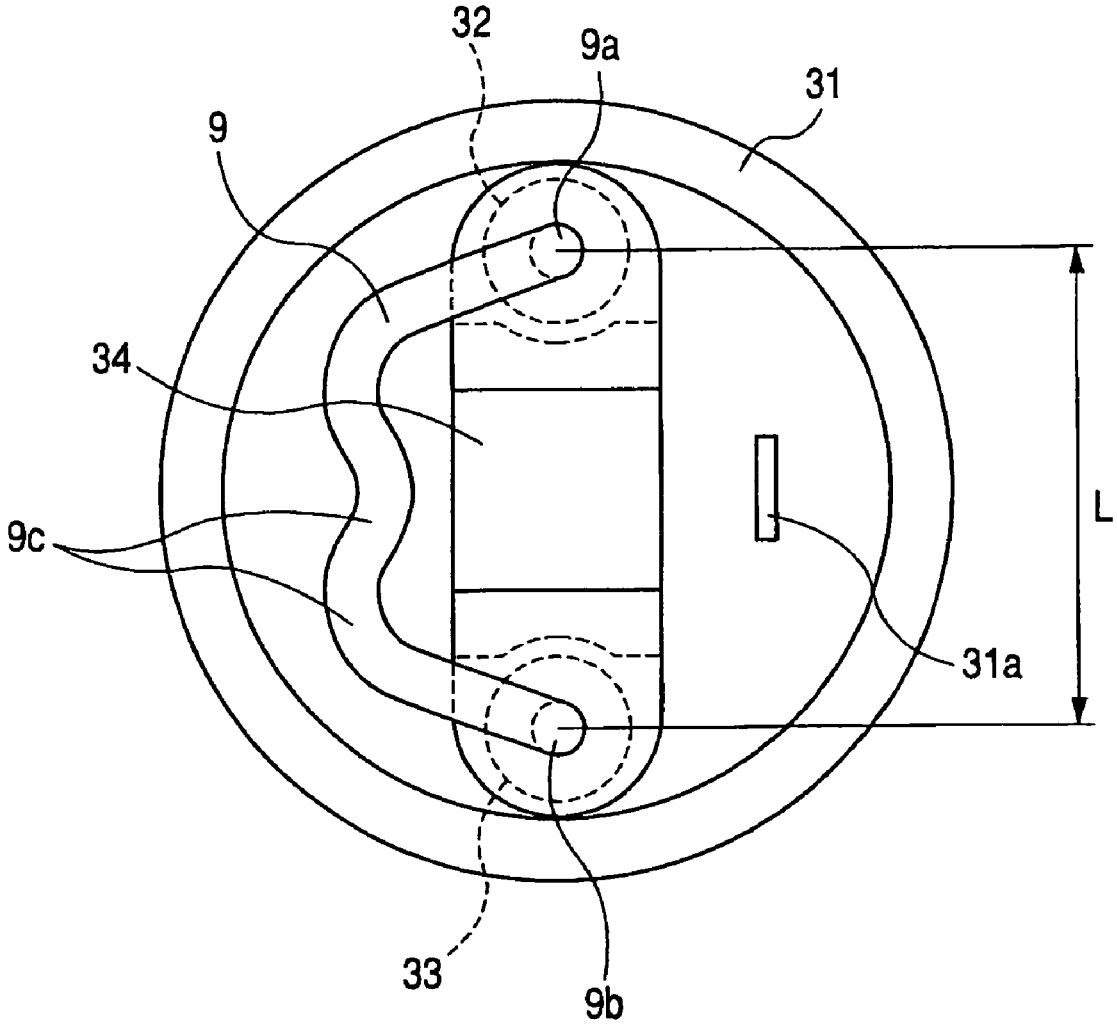
FIG. 4 is a plan view showing the inside of a contact cover provided in the solenoid switch of FIG. 3 from an open end of the contact cover.

The solenoid coil 27 is wound around a resin-made bobbin 35. The solenoid coil 27 has one end electrically connected to an energization terminal 36 (shown in FIG. 2) and the other end grounded. The energization terminal 36 is drawn from the inside to the outside of the contact cover 31 via a through-hole 31*a* which is formed, as shown in FIG. 4, through an end wall of the contact cover 31. The energization terminal 36 is electrically connected to the ECU 25 as shown in FIG. 2.

The magnetic plate 28 is annular in shape and has a circular bore formed through the radial center thereof. The magnetic plate 28 is insert-molded in a resin member 37 that is formed integral with the bobbin 35. The magnetic plate 28 abuts the inner surface of the step portion 26*c* of the case 26, thereby being positioned in the axial direction of the auxiliary switch 10. In addition, the solenoid coil 27 is mechanically fixed to the magnetic plate 28 via the resin member 37.

The fixed core 29 is disposed on the radially inner periphery of the magnetic coil 27 with a rear end face thereof abutting the inner surface of the end wall of the case 26.

The movable core 30 is movable in the axial direction of the auxiliary switch 10 through the circular bore of the magnetic plate 28. The movable core 30 is urged backward by a return spring 38 that is interposed between a step portion of the fixed core 29 and a step portion of the movable core 30.

The contact cover 31 has the shape of a cup with a circular open end. The contact cover 31 is assembled to the case 26 so that a front end portion of the contact cover 31 is fit into a back end portion of the case 26 and the front end face of the contact cover 31 abuts the rear end face of the magnetic plate 28. Further, the contact cover 31 is fixed to the case 26 by crimping part or the whole of the circumference of the back end portion of the case 26 onto the front end portion of the contact cover 31.

A seal member 39, which is implemented by an O-ring, is provided between the contact cover 31 and the case 26 to prevent foreign matter, such as water, from entering the inside of both the contact cover 31 and the case 26.

The terminal bolt 32 is electrically connected to the cathode of the battery 12 via a cable, as shown in FIG. 2. The terminal bolt 32 is fixed to the contact cover 31 by means of a washer 41 and a crimp washer 43. On the other hand, the terminal bolt 33 is both electrically and mechanically connected to the terminal bolt 18 of the main switch 8 via a metal-made connecting member 40 (shown in FIG. 1). The terminal bolt 33 is fixed to the contact cover 31 by means of a washer 42 and a crimp washer 44.

The fixed contacts 45 and 46 are both received in the contact cover 31 and make up a pair of auxiliary contacts of the electric circuit of the starter 1.

As described previously, in the present embodiment, the fixed contacts 45 and 46 are integrally formed respectively with the terminal bolts 32 and 33. However, it should be appreciated that the fixed contacts 45 and 46 may also be separately formed respectively from the terminal bolts 32 and 33 and then joined respectively to the same by, for example, brazing.

The movable contact 34 is also received in the contact cover 31. The movable contact 34 is located on the rear side of the fixed contacts 45 and 46 and coupled to the movable core 30 via a resin-made rod 47.

The movable contact 34 is pressed on a contact-receiving surface 31*b* formed in the contact cover 31 by urging the movable core 30 backward with the force of the return spring 38. Further, around the contact-receiving surface 31, there is formed an annular recess within which a contact pressure spring 48 is disposed. The contact pressure spring 48 applies, when the movable contact 34 is brought into contacts with the fixed contacts 45 and 46, pressure to the movable contact 34 for keeping the contacts between the movable contact 34 and the fixed contacts 45 and 46.

The rod 47 has one end embedded in a radially-central portion of the movable core 30 and the other end that passes through the space between the fixed contacts 45 and 46 to abut the movable contact 34.

The above-described auxiliary switch 10 is disposed, as shown in FIG. 1, close to the main switch 8 in the radial direction of the starter 1. The auxiliary switch 10 is fixed to the housing 2 via a bracket 49.

More specifically, the bracket 49 has a first end portion 49*a* and a second end portion 49*b*. The first end portion 49*a* has a substantially discoid shape; it has a rear surface to which the auxiliary switch 10 is joined by, for example, welding. The second end portion 49*b* has two circular through-holes (not shown) formed therein. The second end portion 49*b* is fixed between the switch-mounting portion 2*b* of the housing 2 and the main switch 8 by means of the two bolts 17 which respectively pass through the two circular through-holes.

The resistor 9 is arranged in an axial space formed within the contact cover 31 of the auxiliary switch 10 between the magnetic plate 28 and the fixed contacts 45 and 46. More specifically, as shown in FIG. 3, the resistor 9 is positioned in the axial direction of the auxiliary switch 10 at predetermined distances from the magnetic plate 28 and the fixed contacts 45 and 46. The resistor 9 has a first end 9*a* electrically and mechanically connected to the bolt terminal 32 and a second end 9*b* electrically and mechanically connected to the terminal bolt 33.

Further, as shown in FIG. 4, the first and second ends 9*a* and 9*b* of the resistor 9 are located away from the radially inner surface of the contact cover 31 by predetermined distances. Moreover, the resistor 9 is configured to extend, on a plane perpendicular to the axial direction of the auxiliary switch 10, between the first and second ends 9*a* and 9*b* with at least two bends 9*c*.

Furthermore, the thermal resistance of the resistor 9 is so predetermined that when the resistor 9 is continuously energized, the resistor 9 melts before the contact cover 31 is thermally damaged, more specially, before the contact cover 31 reaches its softening temperature (e.g., 260° C.).

After having described the overall structure of the starter 1 and the details of the auxiliary switch 10, operation of the starter 1 will now be described with reference to FIG. 5.

First, at a timing T1, the ECU 25 energizes the solenoid coils 15 of the main switch 8, causing a limited current A1 to flow from the battery 12 to the motor 4. Then, at a later timing T2, the ECU 25 further energizes the solenoid coil 27 of the auxiliary switch 10, causing a full current A2 to flow from the battery 12 to the motor 4.

More specifically, at the timing t1, the ECU 25 turns on the starter relay 24, causing electric current to flow from the battery 12 to the solenoid coils 15 of the main switch 8 to energize them. The solenoid coils 15 create, upon being energized, a magnetic attraction for the plunger 16. The magnetic attraction attracts the plunger 16 to move in the leftward direction of FIG. 2, thereby causing the movable contact 20 to connect the fixed contacts 18*a* and 19*a* and the shift lever 7 to shift the pinion 6 rightward.

With the main contacts of the electric circuit (i.e., the fixed contacts 18*a* and 19*a*) closed, the limited current A1, which is limited by the resistor 9, flows from the battery 12 to the motor 4. As a result, the motor 4 rotates at a low speed, facilitating establishment of an engagement between the pinion 6 and the ring gear 5 of the engine.

After the engagement between the pinion 6 and the ring gear 5 has been established, at the timing t2, the ECU 25 energizes the solenoid coil 27 of the auxiliary switch 10. Upon being energized, the solenoid coil 27 makes up an electromagnet together with the fixed core 29. The electromagnet attracts the movable core 30 to move along with the movable contact 34 in the forward direction of FIG. 3, causing the movable contact 34 to connect the fixed contacts 45 and 46.

With the auxiliary contacts of the electric circuit (i.e., the fixed contacts 45 and 46) closed, the resistor 9 is bypassed or short circuited, and consequently the full current A2 flows from the battery 12 to the motor 4. As a result, the motor 4 rotates at a high speed, and the torque generated by the motor 4 is transmitted to the engine via the engagement between the pinion 6 and the ring gear 5, thereby starting the engine.

As soon as the engine has started, at a timing t3, the ECU 25 deenergizes the solenoid coils 15 of the main switch 8 as well as the solenoid coil 27 of the auxiliary switch 10. Consequently, the plunger 16 of the main switch 8 is returned, by the force of the return spring (not shown), to its initial position, thereby causing the movable contact 20 to disconnect the fixed contacts 18*a* and 19*a* (i.e., open the main contacts of the electric circuit). At the same time, the movable contact 34 of the auxiliary switch 10 is returned, by the force of the return spring 38, to its initial position, thereby causing the movable contact 34 to disconnect the fixed contacts 45 and 46 (i.e., open the auxiliary contacts of the electric circuit). As a result, the electric power supply from the battery 12 to the motor 4 is interrupted, causing the motor 4 to stop.

According to the present embodiment, the following advantages can be achieved.

Figure 5:
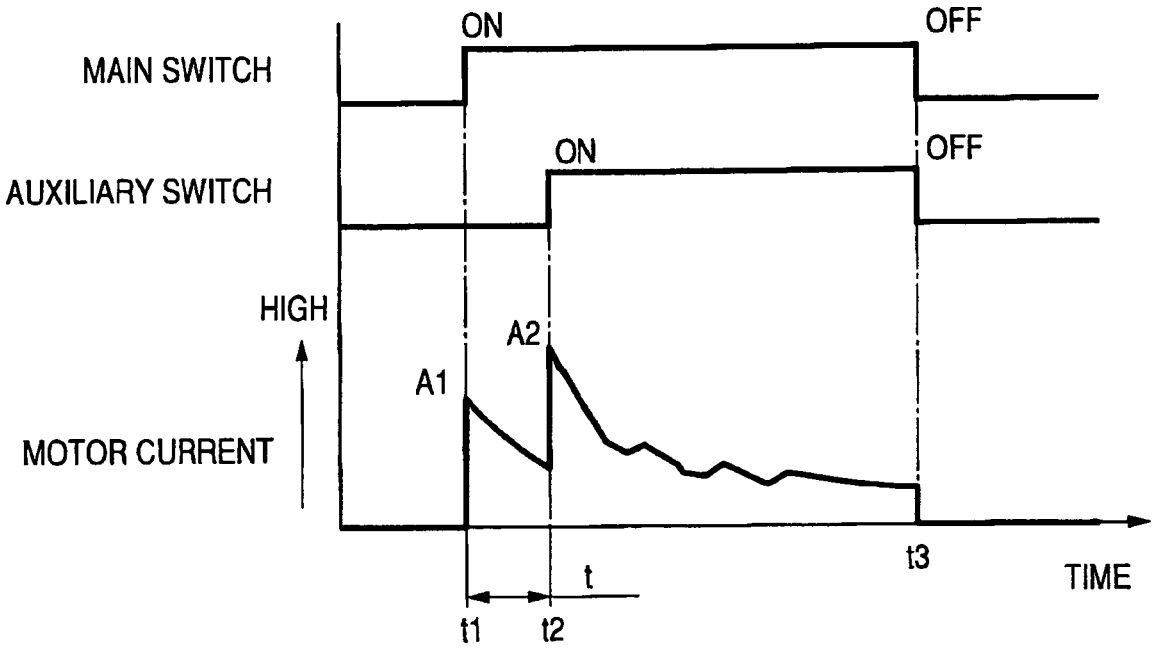
FIG. 5 is a time chart illustrating operation of the starter of FIG. 1.

In the present embodiment, during the initial time period t from the timing t1 to the timing t2 as shown in FIG. 5, only the limited current A1 is supplied to the motor 4. Consequently, the motor 4 is energized to rotate at a low speed, thereby reducing mechanical shocks that occur during establishment of the engagement between the pinion 6 and the ring gear 5 of the engine. As a result, wear of the pinion 6 and ring gear 5 is reduced, thereby improving the durability of the same.

Moreover, with the resistor 9, the inrush current, which flows from the battery 12 to the motor 4 when the motor 4 starts to rotate, is reduced. As a result, the service lives of the fixed and movable contacts 18*a*, 19*a*, and 20 of the main switch 8 as well as those of the brushes 11 of the motor 4 can be extended.

In the present embodiment, the resistor 9 is received in the contact cover 31 of the auxiliary switch 10 and interposed between the magnetic plate 28 and the fixed contacts 45 and 46 in the axial direction of the auxiliary switch 10.

Since the resistor 9 is not arranged on the radially outer periphery of the solenoid coil 27, the outer diameter of the auxiliary switch 10 is reduced in comparison with that of the solenoid switch disclosed in Japanese Patent No. 3767550.

Moreover, in the present embodiment, the case 26 of the auxiliary switch 10 is configured to have the small-diameter portion 26*a* and the large-diameter portion 26*b*. The solenoid coil 27 is received in the small-diameter portion 26*a*, while the resistor 9 is received in the contact cover 31 that is fit into the large-diameter portion 26*b*.

With the above configuration, the outer diameter of the small-diameter portion 26*a* can be minimized, thereby making the auxiliary switch 10 compact.

Further, since the resistor 9 is received in the contact cover 31 and thus not exposed to the outside of the auxiliary switch 10, it is possible to protect the resistor 9 from foreign matter, such as water, thereby improving the durability of the resistor 9. In addition, since no flammable gas can reach the resistor 9, it is possible to ensure the safety of the auxiliary switch 10 when the resistor 9 comes to glow after a long-time energization thereof.

Furthermore, since the resistor 9 is located away from the solenoid coil 27, it does not influence dissipation of heat generated by the solenoid coil 27. Moreover, with the magnetic plate 28 interposed between the solenoid coil 27 and the resistor 9, it is possible to block heat generated by the resistor 9 from transferring to the solenoid coil 27, thereby ensuring the thermal resistance and excitation performance of the solenoid coil 27.

In the present embodiment, the movable contact 34 of the auxiliary switch 10 is located further from the magnetic plate 28 than the fixed contacts 45 and 46. In other words, the movable contact 34 is not interposed between the magnetic plate 28 and the fixed contacts 45 and 46 in the axial direction of the auxiliary switch 10. Consequently, there is no risk of the movable contact 34 making contact with the resistor 9, thus improving the reliability of the auxiliary switch 10.

In the present embodiment, the resistor 9 has the first end 9*a* electrically and mechanically connected to the bolt terminal 32 and the second end 9*b* electrically and mechanically connected to the terminal bolt 33. Moreover, the terminal bolts 32 and 33 respectively have the fixed contacts 45 and 46 formed therein. Consequently, heat generated by the resistor 9 can be easily transmitted to the fixed contacts 45 and 46. As a result, even when the temperature of the terminal bolts 32 and 33 are lowered by external cold air, it is still possible to prevent the electrical conductivity of the fixed contacts 45 and 46 from dropping due to, for example, dew formation and freezing.

In the present embodiment, the resistor 9 is located away from the magnetic plate 28 and the fixed contacts 45 and 46 by the predetermined distances. Further, as shown in FIG. 4, the first and second ends 9*a* and 9*b* of the resistor 9 are located away from the radially inner surface of the contact cover 31 by the predetermined distances. Consequently, it is difficult for the contact cover 31 to be damaged by heat generated by the resistor 9.

Further, in the present embodiment, the thermal resistance of the resistor 9 is so predetermined that the resistor 9 melts before the resin-made contact cover 31 reaches its softening temperature.

When the movable contact 34 cannot normally connect the fixed contacts 45 and 46, the resistor 9 will be continuously energized and thus come to glow. However, with the above configuration, the resistor 9 will melt before the contact cover 31 is thermally damaged. Consequently, it is possible to improve the reliability and safety of the auxiliary switch 10.

In the present embodiment, the resistor 9 is configured to extend, on a plane perpendicular to the axial direction of the auxiliary switch 10, between the first and second ends 9*a* and 9*b* with at least two bends 9*c*.

With the above configuration, it is possible to set the resistance of the resistor 9 to a desired value by adjusting the length of the resistor 9. In addition, during the process of joining the first and second ends 9*a* and 9*b* of the resistor 9 to the terminal bolts 32 and 33, it is easy to bend the resistor 9 to bring the distance between the first and second ends 9*a* and 9*b* into agreement with a desired distance L as shown in FIG. 4.

Second Embodiment

This embodiment illustrates a method of joining the resistor 9 to the terminal bolts 32 and 33.

Figure 6:
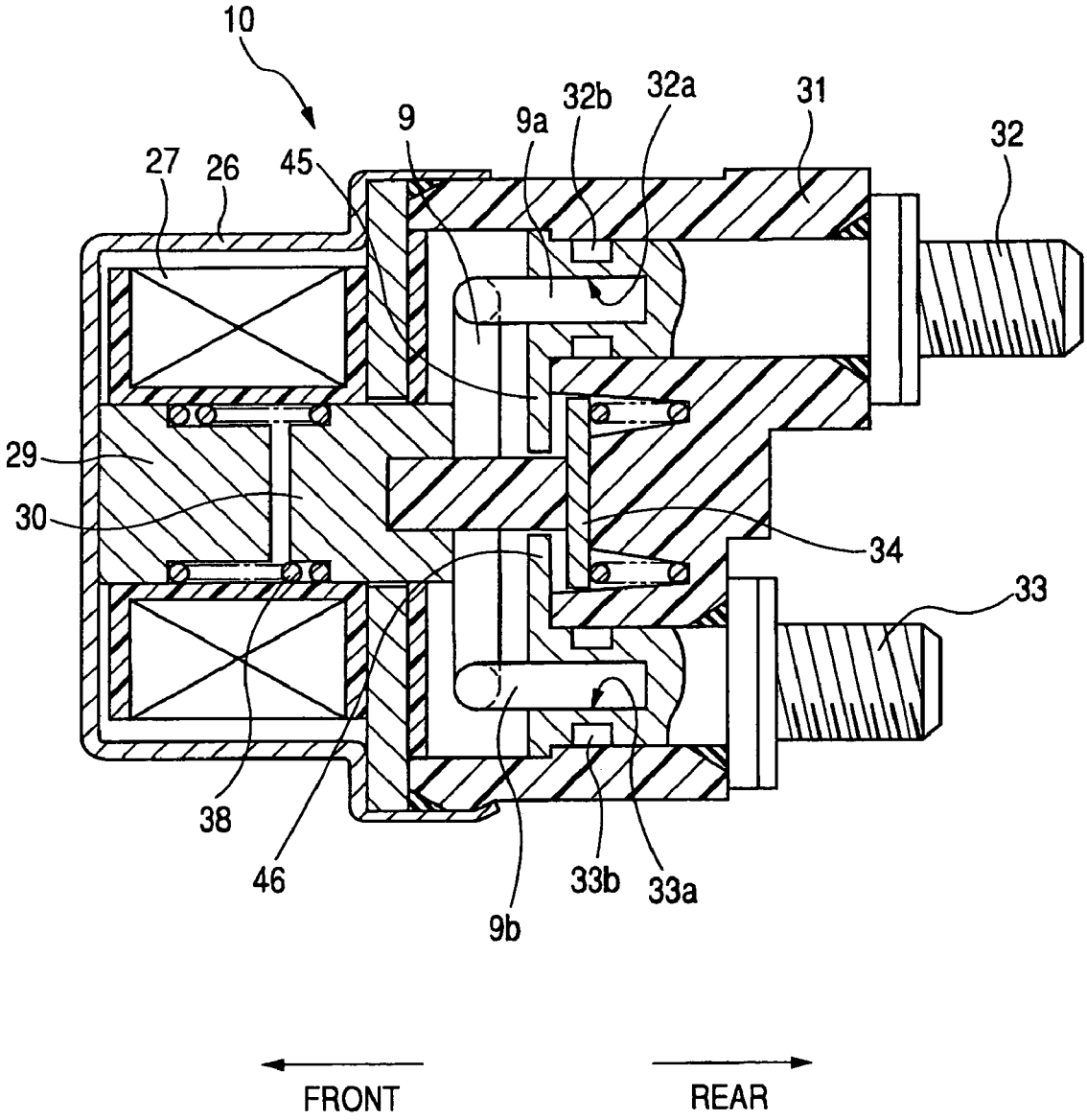
FIG. 6 is a partially cross-sectional view of a solenoid switch according to the second embodiment of the invention.

Referring to FIG. 6, in the present embodiment, the terminal bolt 32 has a bore 32*a* that opens on the front end face of the terminal bolt 32 and has a predetermined depth. The terminal bolt 32 also has two recesses 32*b* that are formed in the side surface of the terminal bolt 32 and opposed to each other in the radial direction of the terminal bolt 32 with the bore 32*a* interposed therebetween. Similarly, the terminal bolt 33 has a bore 33*a* that opens on the front end face of the terminal bolt 33 and has a predetermined depth. The terminal bolt 33 also has two recesses 33*b* that are formed in the side surface of the terminal bolt 33 and opposed to each other in the radial direction of the terminal bolt 33 with the bore 33*a* interposed therebetween. It should be noted that in FIG. 6, the forward and backward directions are introduced only for convenience of explanation.

The first end 9*a* of the resistor 9 is inserted in the bore 32*a* of the terminal bolt 32. Further, the terminal bolt 32 is crimped onto the first end 9*a* of the resistor 9 by press-deforming the bottoms of the recesses 32*b* radially inward. On the other hand, the second end 9*b* of the resistor 9 is inserted in the bore 33*b* of the terminal bolt 33. Further, the terminal bolt 33 is crimped onto the second end 9*b* of the resistor 9 by press-deforming the bottoms of the recesses 33*b* radially inward.

With the above joining method according to the present embodiment, the first and second ends 9*a* and 9*b* of the resistor 9 can be securely joined to the terminal bolts 32 and 33 without heating the whole of the resistor 9 and terminal bolts 32 and 33 as in the case of applying furnace brazing.

Consequently, the strengths of the terminal bolts 32 and 33 can be prevented from being lowered during the joining process. As a result, it is possible to securely fasten cable terminals onto the terminal bolts 32 and 33 without damaging the terminal bolts 32 and 33.

Moreover, with the above joining method, only part of the terminal bolt 32 around the recesses 32*b* and only part of the terminal bolt 33 around the recesses 33*b* are press-deformed during the crimping. Consequently, the bending-deformations of the entire terminal bolts 32 and 33 can be reduced.

In addition, the resistor 9 may also be joined to the terminal bolts 32 and 33 by the following brazing method.

First, a filler metal paste is filled in the bores 32*a* and 33*a* of the terminal bolts 32 and 33. Then, the first and second ends 9*a* and 9*b* of the resistor 9 are respectively inserted into the bores 32*a* and 33*a* of the terminal bolts 32 and 33. Thereafter, only part of the terminal bolt 32 around the bore 32*a* and only part of the terminal bolt 33 around the bore 33*a* are heated to melt the filler metal paste, thereby joining the first and second ends 9*a* and 9*b* of the resistor 9 respectively to the terminal bolts 32 and 33.

With the above brazing method, it is also possible to achieve the same advantages as with the joining method according to the present embodiment.

Third Embodiment

This embodiment illustrates anther method of joining the resistor 9 to the terminal bolts 32 and 33.

Figure 7:
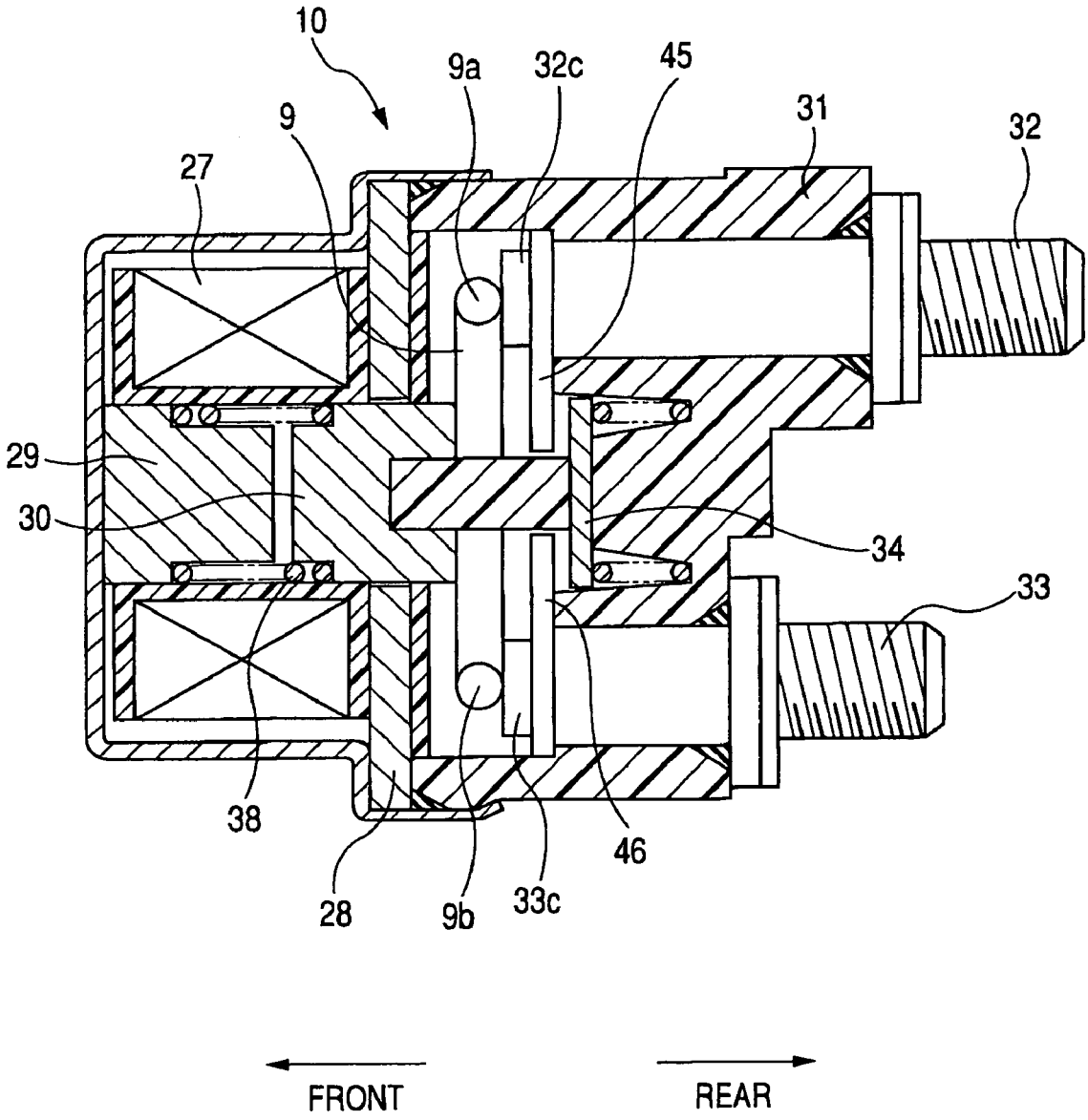
FIG. 7 is a partially cross-sectional view of a solenoid switch according to the third embodiment of the invention.
Figure 8:
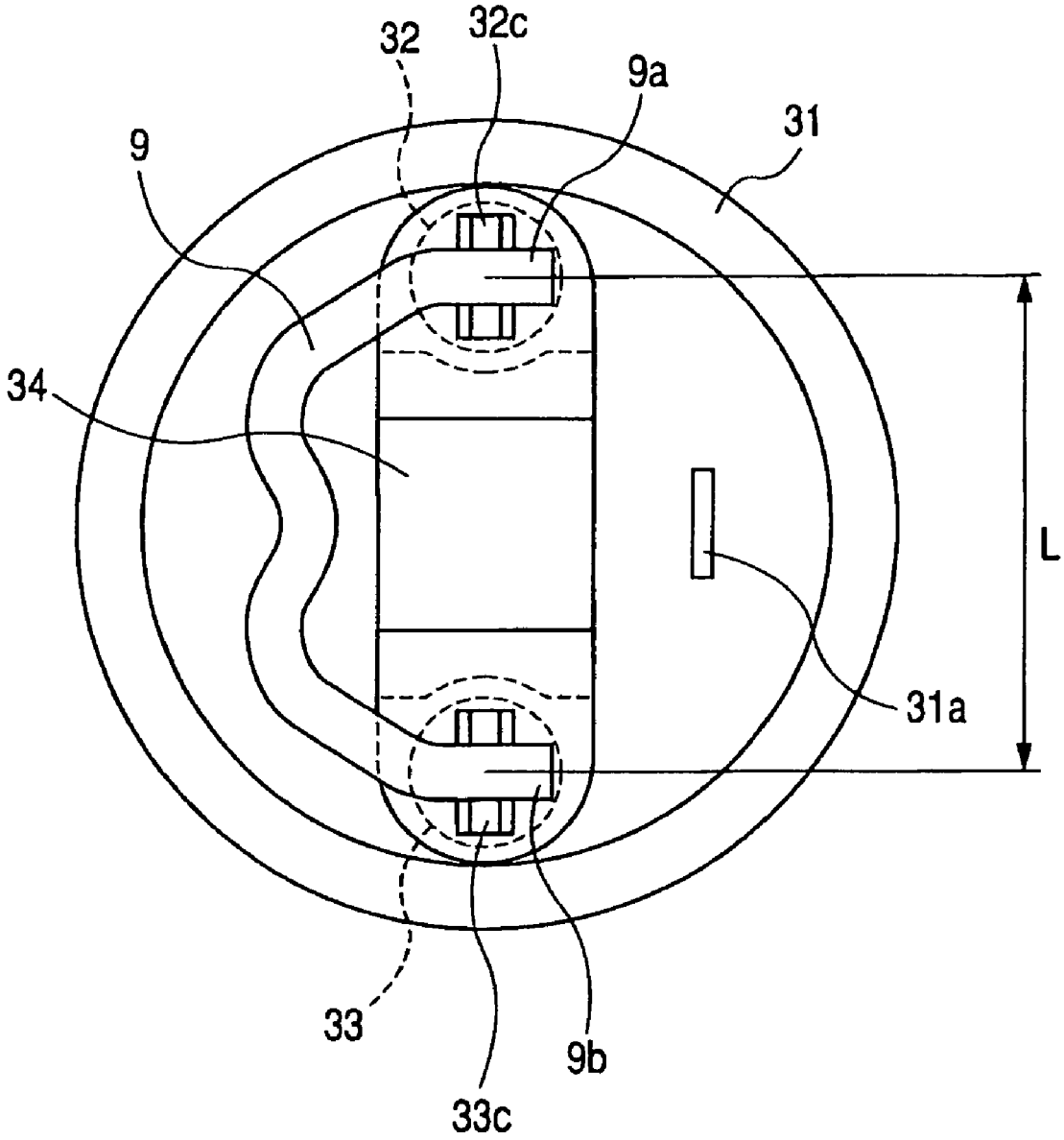
FIG. 8 is a plan view showing the inside of a contact cover provided in the solenoid switch of FIG. 7 from an open end of the contact cover.

Referring to FIG. 7, in the present embodiment, the terminal bolt 32 has a protrusion 32*c* that protrudes from the front end face of the terminal bolt 32 to have a predetermined protruding height from the front end face. Further, as shown in FIG. 8, the protrusion 32*c* has a rectangular bottom and tapers toward its top to have a trapezoidal cross section. Similarly, the terminal bolt 33 has a protrusion 33*c* that protrudes from the front end face of the terminal bolt 33 to have the predetermined protruding height from the front end face. Further, as shown in FIG. 8, the protrusion 33*c* has a rectangular bottom and tapers toward its top to have a trapezoidal cross section.

The first and second ends 9*a* and 9*b* of the resistor 9 are respectively disposed on the tops of the protrusions 32*c* and 33*c* of the terminal bolts 32 and 33, and respectively joined to the tops of the protrusions 32*c* and 33*c* by projection welding.

Further, as shown in FIG. 8, the length of the protrusions 32*c* and 33*c* of the terminal bolts 32 and 33 is sufficiently larger (e.g., three times) than the diameter of the resistor 9. Furthermore, as shown in FIG. 7, the protruding height of the protrusions 32*c* and 33*c* of the terminal bolts 32 and 33 is so predetermined as to locate the resistor 9 almost at the same distance from the magnetic plate 28 and the first and second fixed contacts 45 and 46 in the axial direction of the auxiliary switch 10.

With the above joining method according to the present embodiment, the first and second ends 9*a* and 9*b* of the resistor 9 can be securely joined to the terminal bolts 32 and 33 without heating the whole of the resistor 9 and terminal bolts 32 and 33 as in the case of applying furnace brazing.

Consequently, the strengths of the terminal bolts 32 and 33 can be prevented from being lowered during the joining process. As a result, it is possible to securely fasten cable terminals onto the terminal bolts 32 and 33 without damaging the terminal bolts 32 and 33.

Moreover, with the length of the protrusions 32*c* and 33*c* of the terminal bolts 32 and 33 sufficiently larger than the diameter of the resistor 9, it is possible to reliably prevent the first and second ends 9*a* and 9*b* of the resistor 9 from being detached from the protrusions 32*c* and 33*c* during the projection welding. Further, it is also possible to accurately set the distance between the first and second ends 9*a* and 9*b* to the desired distance L.

While the above particular embodiments of the present invention have been shown and described, it will be understood by those skilled in the art that various modifications, changes, and improvements may be made without departing from the spirit of the invention.

For example, in the first embodiment, the auxiliary switch 10 is fixed to the housing 2 of the starter 1 via the bracket 49.

However, when it is difficult to locate the auxiliary switch 10 along with the starter 1 in the engine compartment, it is possible to separately locate the auxiliary switch 10 from the starter 1 without being connected to the housing 2.

Moreover, in the previous embodiments, the present invention is applied to the auxiliary switch 10 which is employed in the starter 1 for starting the internal combustion engine.

However, the present invention may also be applied to any other solenoid switch which is connected to an electric circuit to control current flowing through the electric circuit in two stages.

What is claimed is:

1. A solenoid switch comprising:

a solenoid coil having a longitudinal axis;

a fixed core surrounded by the solenoid coil;

an annular magnetic plate that is disposed on one side of the solenoid coil in an axial direction of the solenoid coil, the magnetic plate having a through-hole formed through a radial center thereof;

a movable core that is movable in the axial direction of the solenoid coil toward and away from the fixed core through the through-hole of the magnetic plate;

a resin-made contact cover that is arranged with the magnetic plate interposed between the contact cover and the solenoid coil in the axial direction of the solenoid coil;

first and second terminals that are fixed to the contact cover and protrude outside of the contact cover so as to be connected to an electric circuit;

first and second fixed contacts that are received in the contact cover and respectively electrically connected to the first and second terminals;

a movable contact that is received in the contact cover and configured to be moved along with the movable core to electrically connect and disconnect the first and second fixed contacts; and a resistor that is electrically connected between the first and second terminals to limit current flowing through the electric circuit when the first and second fixed contacts are electrically disconnected, the resistor being received in the contact cover and interposed between the magnetic plate and the first and second fixed contacts in the axial direction of the solenoid coil.

2. The solenoid switch as set forth in claim 1, wherein the resistor has first and second ends that are respectively joined to the first and second terminals and located away from a radially inner surface of the contact cover by predetermined distances.

3. The solenoid switch as set forth in claim 1, wherein the resistor has first and second ends that are respectively joined to the first and second terminals, and the resistor extends, on a plane perpendicular to the axial direction of the solenoid coil, between the first and second ends with at least two bends.

4. The solenoid switch as set forth in claim 1, wherein the thermal resistance of the resistor is so predetermined that when the resistor is continuously energized, the resistor melts before the contact cover reaches its softening temperature.

5. The solenoid switch as set forth in claim 1, wherein each of the first and second terminals is shaped as a bolt with a bore and two recesses, the bore opening on an axial end face of the bolt and having a predetermined depth, the two recesses being formed in a side surface of the bolt and opposed to each other in a radial direction of the bolt with the bore interposed therebetween, and the resistor has first and second ends, the first end being inserted in the bore of the first terminal and joined to the first terminal by press-deforming bottoms of the recesses of the first terminal radially inward, the second end being inserted in the bore of the second terminal and joined to the second terminal by press-deforming bottoms of the recesses of the second terminal radially inward.

6. The solenoid switch as set forth in claim 1, wherein each of the first and second terminals is shaped as a bolt with a bore that opens on an axial end face of the bolt and has a predetermined depth, a brazing filler metal is provided in the bores of the first and second terminals, and the resistor has first and second ends, the first end being inserted in the bore of the first terminal and joined to the first terminal by heating only part of the first terminal around the bore to melt the brazing filler metal in the bore, the second end being inserted in the bore of the second terminal and joined to the second terminal by heating only part of the second terminal around the bore to melt the brazing filler metal in the bore.

7. The solenoid switch as set forth in claim 1, wherein each of the first and second terminals is shaped as a bolt with a protrusion that protrudes from an axial end face of the bolt by a predetermined distance, and the resistor has first and second ends that are respectively welded to the protrusions of the first and second terminals.

8. The solenoid switch as set forth in claim 1, wherein the electric circuit, to which the first and second terminals are to be connected, is an electric circuit for supplying electric power to a starter motor.

9. The solenoid switch as set forth in claim 1, further comprising a cup-shaped case that has first and second portions, the first portion including a closed end of the case and having the solenoid coil received therein, the second portion including an open end of the case and having an end portion of the contact cover fit thereinto, the first portion having a smaller outer diameter than the second portion.

10. The solenoid switch as set forth in claim 1, wherein the movable contact is located further from the magnetic plate than the first and second fixed contacts in the axial direction of the solenoid coil.

11. The solenoid switch as set forth in claim 1, wherein each of the first and second terminals is shaped as a bolt, and the first and second fixed contacts are formed respectively integral with the first and second terminals.

* * * * *